US006009679A

United States Patent [19]

Larsen

[11] Patent Number: 6,009,679

[45] Date of Patent: Jan. 4, 2000

[54] WALL ELEMENTS FOR WOODEN BUILDINGS, A METHOD FOR MANUFACTURE THEREOF AND A METHOD FOR ERECTION OF WOODEN BUILDING WITH SUCH WALL ELEMENTS

[75] Inventor: Poul Erik Larsen, Østbirk, Denmark

[73] Assignee: V. Kann Rasmussen Industri A/S, Søborg, Denmark

[21] Appl. No.: 08/765,892

[22] PCT Filed: Jul. 12, 1995

[86] PCT No.: PCT/DK95/00302

§ 371 Date: Jan. 8, 1997

§ 102(e) Date: Jan. 8, 1997

[87] PCT Pub. No.: WO96/01931

PCT Pub. Date: Jan. 25, 1996

[30] Foreign Application Priority Data

Jul. 12, 1994 [DK] Denmark ..... 0840

[51] Int. Cl.[7] ..... E04C 2/10; E04B 1/10

[52] U.S. Cl. ..... 52/578; 52/233; 52/302.1; 52/539; 52/590.3

[58] Field of Search ..... 52/578, 533, 536, 52/539, 540, 541, 591.5, 591.1, 233, 238, 394, 592.4, 590.3, 302.1, 235

[56] References Cited

U.S. PATENT DOCUMENTS

| | | | |
|---|---|---|---|
| 1,859,667 | 5/1932 | Gruner | 52/539 X |
| 1,986,739 | 1/1935 | Mitte | 52/591.4 |
| 2,021,341 | 11/1935 | Ward | 52/233 X |
| 2,241,642 | 5/1941 | McCauley | 52/539 |
| 2,264,546 | 12/1941 | Ochs | 52/521 X |
| 2,320,466 | 6/1943 | Presley | 52/233 X |
| 2,354,202 | 7/1944 | Dennis | 52/233 X |
| 2,908,048 | 10/1959 | Johnson | 52/539 X |
| 3,284,967 | 11/1966 | Elliott et al. | 52/539 X |
| 3,771,271 | 11/1973 | Keel | 52/540 X |
| 4,047,350 | 9/1977 | Chisum | 52/593 |
| 4,115,969 | 9/1978 | Napier | 52/233 |
| 4,807,413 | 2/1989 | Randall | 52/233 |
| 4,903,477 | 2/1990 | McDade | 52/533 X |
| 5,020,289 | 6/1991 | Wrightman | 52/233 |
| 5,060,432 | 10/1991 | Christian | 52/233 |
| 5,182,892 | 2/1993 | Chase | 52/539 |

FOREIGN PATENT DOCUMENTS

| | | | |
|---|---|---|---|
| 41970 | 12/1925 | Norway | 52/238 |
| 240737 | 6/1946 | Switzerland | 52/539 |

*Primary Examiner*—Christopher T. Kent
*Assistant Examiner*—Winnie S. Vip
*Attorney, Agent, or Firm*—Lane, Aitken & McCann, L.L.P.

[57] ABSTRACT

A wall element for wooden building comprises a number of board members (11, 23) of uniform length which are joined side by side by designing the opposite side edges of the elements with cooperating engagement members which between two neighboring elements provide a joint with labyrinth seal forming a pressure-reducing passage for wind loads on the exterior of the element. On the internal side, the board members (11, 23) are retained by transverse lath elements (12, 13; 24) by means of screw connections through the lath elements (12, 13; 24) into the backside of the board members (11, 23). At its top and bottom edges, the wall element is designed with cooperating bevel faces (29–32) for joining of overlying wall elements in a locked engagement.

19 Claims, 9 Drawing Sheets

19

Figure 1:
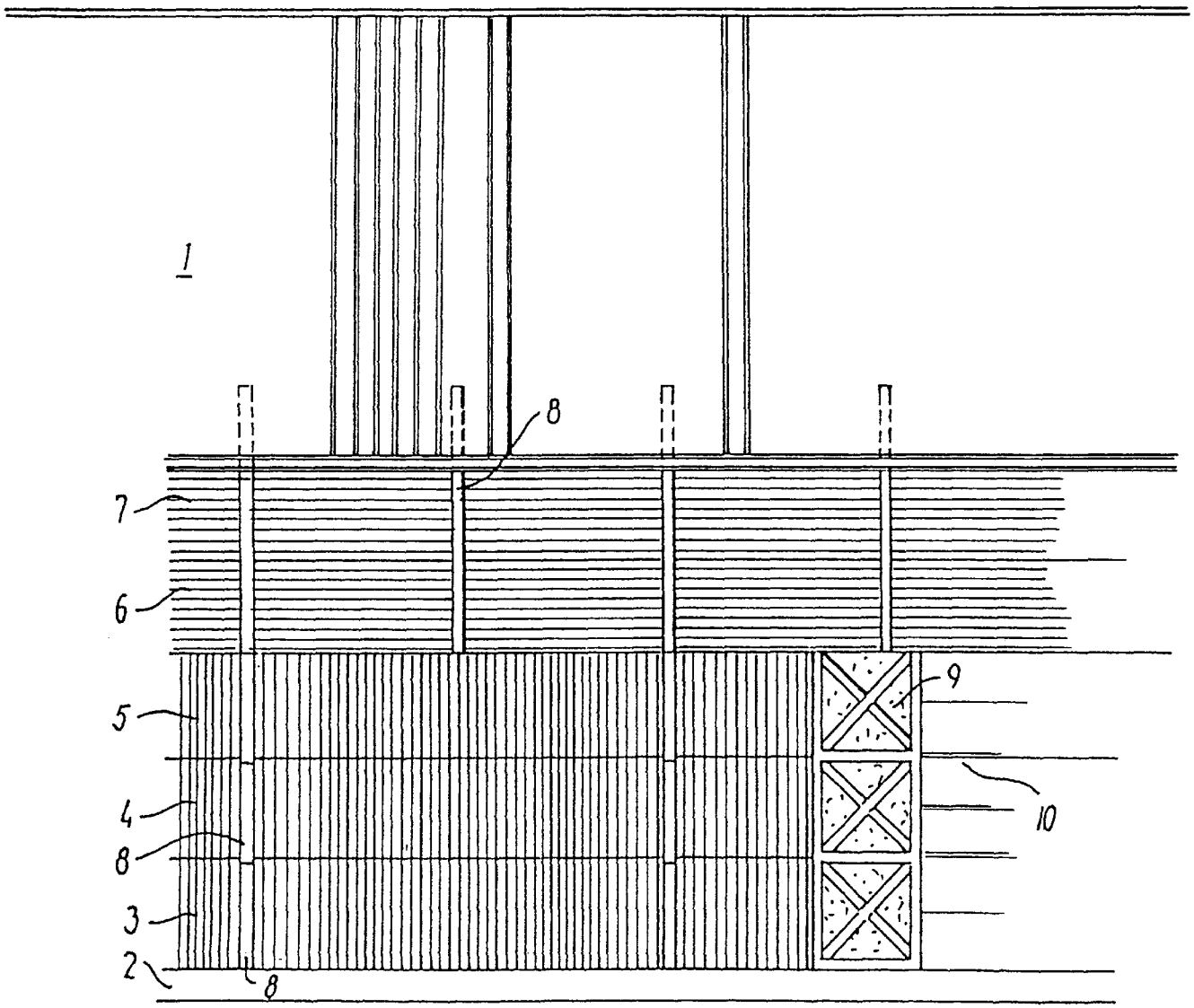

WALL ELEMENTS FOR WOODEN BUILDINGS, A METHOD FOR MANUFACTURE THEREOF AND A METHOD FOR ERECTION OF WOODEN BUILDING WITH SUCH WALL ELEMENTS

The present invention relates to wall elements for wooden buildings, with a number of board members of uniform length fastened side by side to transverse lath elements on the inside of the board members in the proximity of the mutually flushing end edges thereof, the opposite side edges of the board members being designed with cooperating engagement members.

Wooden buildings with boarded walls are generally erected in situ by fastening building boards individually to a wooden framework serving as supporting building structure for accommodating static and dynamical loads and transmission thereof to the base of the building.

The boarding forms a socalled weather screen for protection of possible insulation and interior wall behind. On the inside of the boarding, there will normally be arranged a layer of diffusion-open, wind-proof cardboard or paper, and in order to ensure a good ventilation behind the weather screen, the insulation is generally arranged with a clearance in relation to the windproof cardboard or paper.

The cover boards may be fastened either vertically, horizontally or askew. In boarding with horizontal boards, a clinker-structure or special profiled boards may be used. In vertical boarding, the individual boards may be designed for tongue-and-groove engagement or they may be arranged in two layers such that edge zones of a board in one layer is in contact with edge zones of two boards mutually spaced apart in the other layer.

As distinct from this conventional technology it is known eg. from U.S. Pat. No. 4,115,969 to prefabricate larger wall elements of the above-stated type for wooden buildings with the purpose of facilitating the erection of wooden buildings for a number of different purposes and of shortening the time of erection. Such wall elements must therefore be prefabricated with a size and a weight permetting their handling by two men during transport and mounting on the building site.

It is the object of the invention to provide a design of such wall elements enabling joints between the boards to remain essentially stressfree under varying moisture content in the building boards and, at the same time, with the joints designed in such a way that they are always tight independently of air humidity and rain and wind impacts. Thus, the arrangement of a wind-proof backcoating may be dispensed with.

It is a further object of the invention to provide a wall element design permitting the use of pressure-creosoted wooden structures to be avoided thereby taking into account important environmental considerations and, at the same time, reducing the costs.

With this object in view, a wall element according to the invention is characterized in that the engagement elements between two neighboring board members form a labyrinth seal with at least two series connected pressure-reducing chambers for wind load on the exterior of the board member, which labyrinth seal forms against the external side of the member a drainage slit for removal of water collected from the pressure-reducing chamber situated nearest said external side.

Through the design of the wall elements with a view to prefabrication, substantial advantages are obtained, as the method for manufacture may be devised more rationally and under optimal conditions compared to what can be obtained on a building site.

With the design according to the invention of the joints between the building boards, these will thus comprise two series connected relief spaces for wind load on the exterior of the building, draught in the interior of the building being thereby avoided and at the same time, a good ventilation and dust-tight joints being obtained.

The fastening of the board members to the lath elements by means of screw connections which are merely inserted in the backside of the board members, entails that externally accessible screws that may be exposed to the weather can be completely avoided.

In a preferred embodiment, the wall element is at its top and bottom edges designed with cooperating bevel faces for joining overlying wall elements in a locked engagement. Thereby, the elements may be fastened to the supporting wooden framework at the top edge and perhaps along the vertical side edges whereas screw and bolt connections along the bottom edge may be avoided which contributes to avoiding stress in the building structure as a consequence of varying moisture absorption in the wood and at the same time, money and time are saved.

Wall elements according to the invention may be designed both with vertical and horizontal building boards.

A design with vertical covering boards may according to the invention be characterized in that the board members form vertically disposed bars and that the lath elements comprise an upper element flushing with the top end edges of the bars and a lower element situated at a distance above the bottom edges of the bars, said bevel faces being provided at the underside of the lower lath element and at the top edges of the bars.

The labyrinth seal between mutually butting side edges of neighboring board members may be formed by a double groove-and-tongue joint with said pressure-reducing chambers provided at the bottom of the grooves.

If horizontal building boards are desired, this may according to the invention be obtained through a preferred embodiment which is characterized in that the board members form vertically disposed elements with an essentially wedge-shaped cross section with largest width at the bottom side edge for creation of a clinker-built appearance of the assembled wall element, and are connected by means of vertically disposed lath elements.

In this embodiment, the labyrinth seal between to mutually butting side edges of neighbouring board members may comprise a groove-and-tongue joint with an upward projecting tongue from the top side of the board member and a groove in the underside and an external downward projecting nose outside said groove, said drainage slit being provided between said nose and a top edge zone covered thereby of the exterior of the underlying board member.

Wall elements with vertical and horizontal building boards, respectively, may be used in one and the same building structure in the way that the top and bottom end edges of the vertically disposed lath elements are designed for a wall element with horizontal building boards with parallel bevel faces corresponding to the bevel face at the top edge of the vertical bars in a wall element with vertical boarding.

The invention relates moreover to a method for manufacture of wall elements of the stated type.

In order to ensure the effect aimed at for the joints between the board members as labyrinth seals forming double pressure-reducing canals for the wind loading together with retention of an essentially stressfree structure under varying moisture absorption in the wood, this method is according to the invention characterized in that the board members are cut up with the grains running essentially parallel to the external and the internal side, that the moisture content of the wood is determined, and that at the junction of the board members with the lath elements there is performed an adaptation of the engagement between said engagement members in accordance with the thus controlled moisture conditions.

In addition, the invention relates to a method for erection of a wooden building with a facade consisting of wall elements of the above type.

To this end, in wall elements with vertical covering is used a design whereby the top lath element at its upper side is designed with an engagement member for joining with an engagement member in the lower side of a mounting and cover lath element which upon mounting of a overlying wall element is fastened along the lower board member thereof for fastening of the overlying element by means of said engagement.

Furthermore, by application of wall elements with vertical covering is used a design where to the top ends of the vertically disposed lath elements on the inside thereof is fastened a horizontal lath element for fastening of a beam element in the supporting building structure, which element at its upper side is designed with an engagement member for junction with an engagement member in the lower side of a mounting and cover lath element which upon mounting of a overlying wall element is fastened along the lower board member thereof.

According to the invention, the last-mentioned method is characterized in that at its vertical side edges and at its top edge each wall element is fastened by screw connections to vertical posts and a horizontal beam element, respectively, in a supporting structure of the building, whereas at its lower edge, it is only retained to an underlying element or to a wall plate in the building structure by means of said bevel faces and mounting element.

Figure 2:
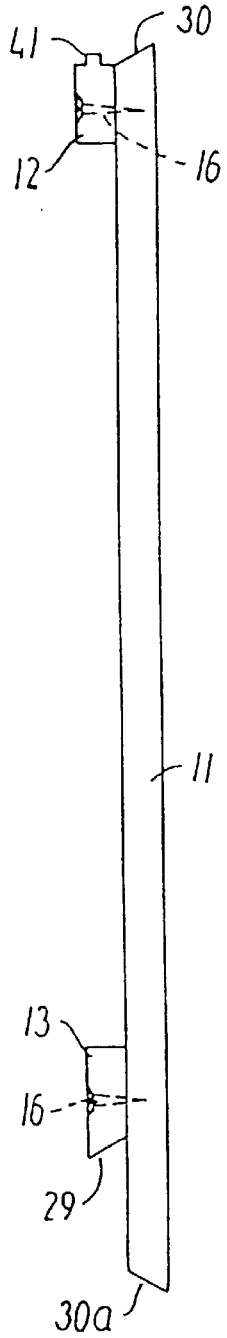
Figure 3:
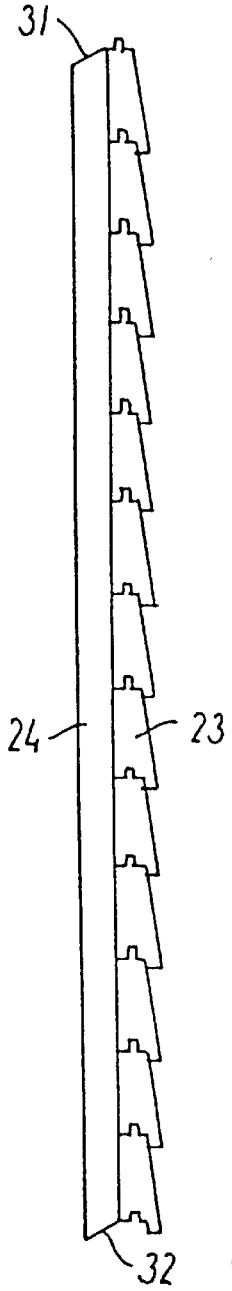
Figure 4:
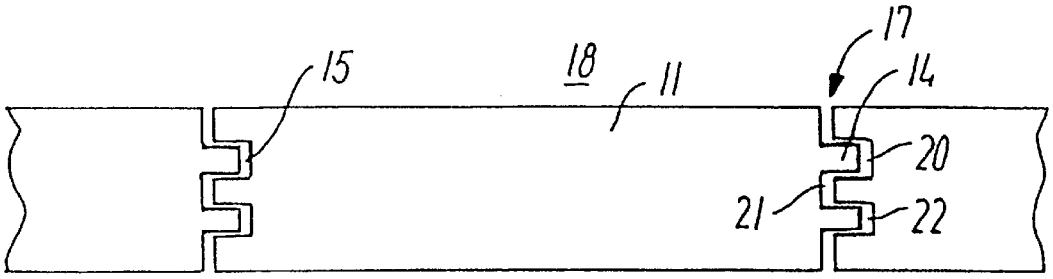
Figure 6:
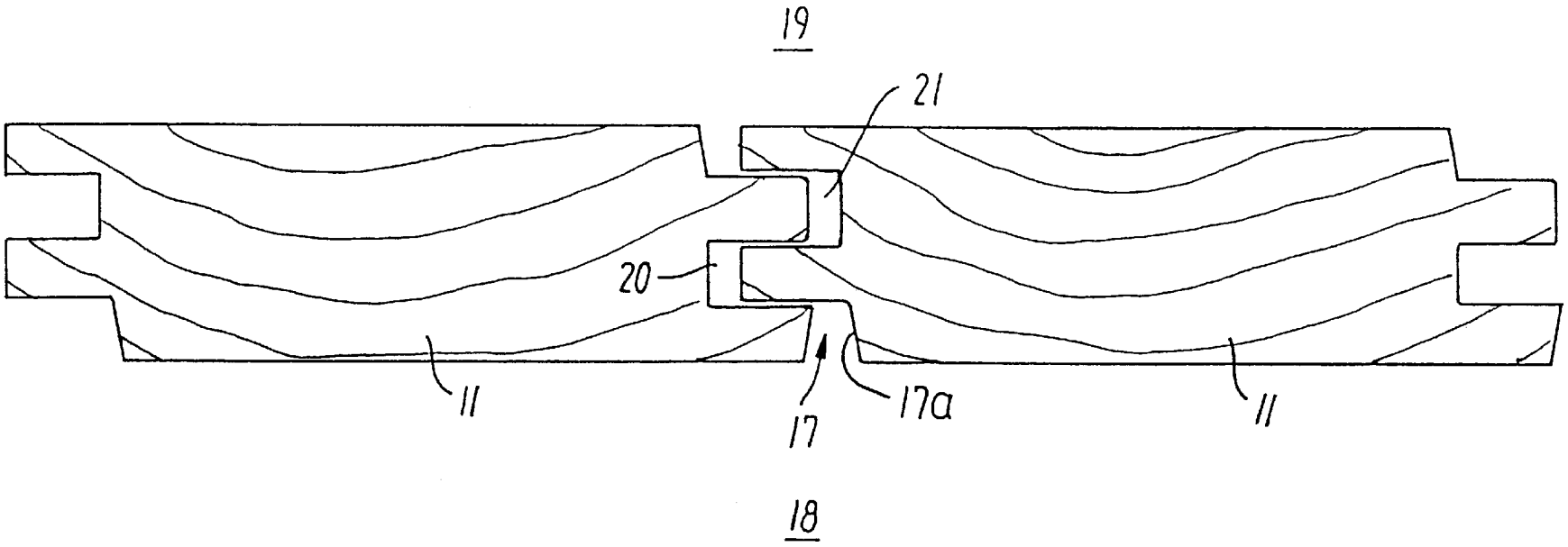
Figure 7:
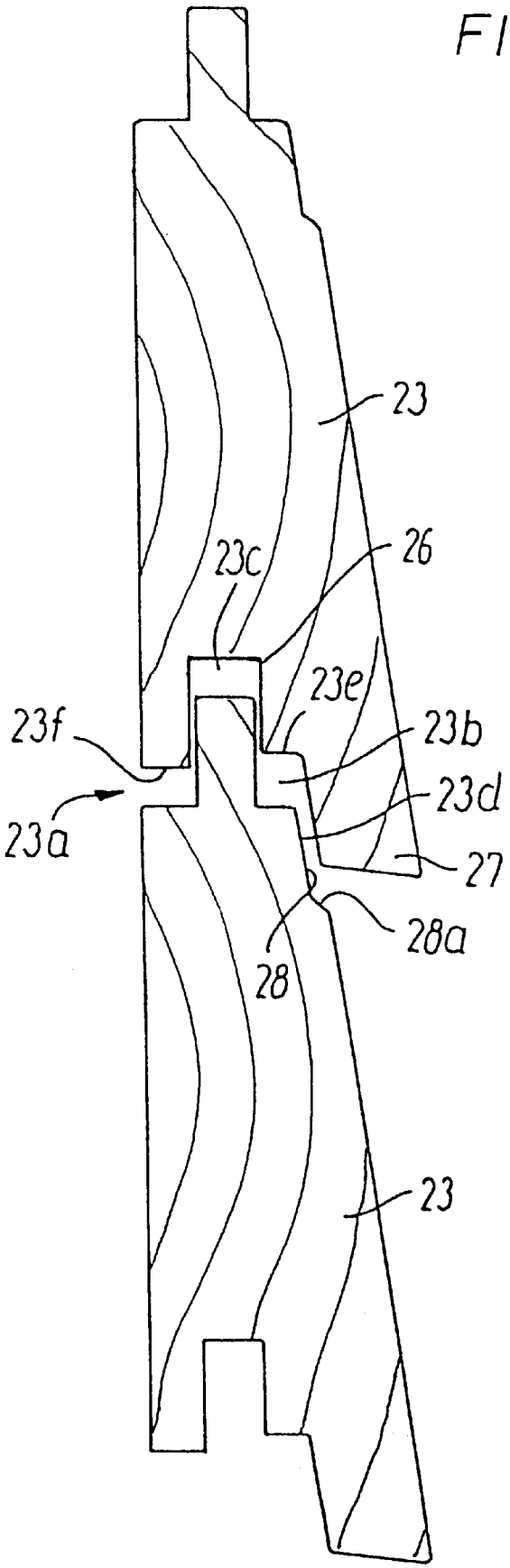

In the following, the invention will be further explained with reference to the schematical drawing, where FIG. 1 shows an example of a wooden building with a wall section constructed by embodiments of wall elements according to the invention, FIGS. 2 and 3 show vertical sectional views of embodiments of a wall element according to the invention with vertically and horizontally disposed board members, respectively, FIG. 4 shows a section of a horizontal sectional view of the embodiment shown in FIG. 2, FIG. 5 on a larger scale the junctions between the horizontally disposed board members by the embodiment in. FIG. 3, FIGS. 6 and 7 show preferred embodiments for a vertically disposed and a horizontally disposed, respectively board member, FIGS. 8–10 three examples of interconnection of overlying wall elements in the embodiments shown in FIGS. 2 and 3, FIG. 11 and 12 two examples of wall elements positioned side by side of the embodiment shown in FIG. 2.

Figure 13:
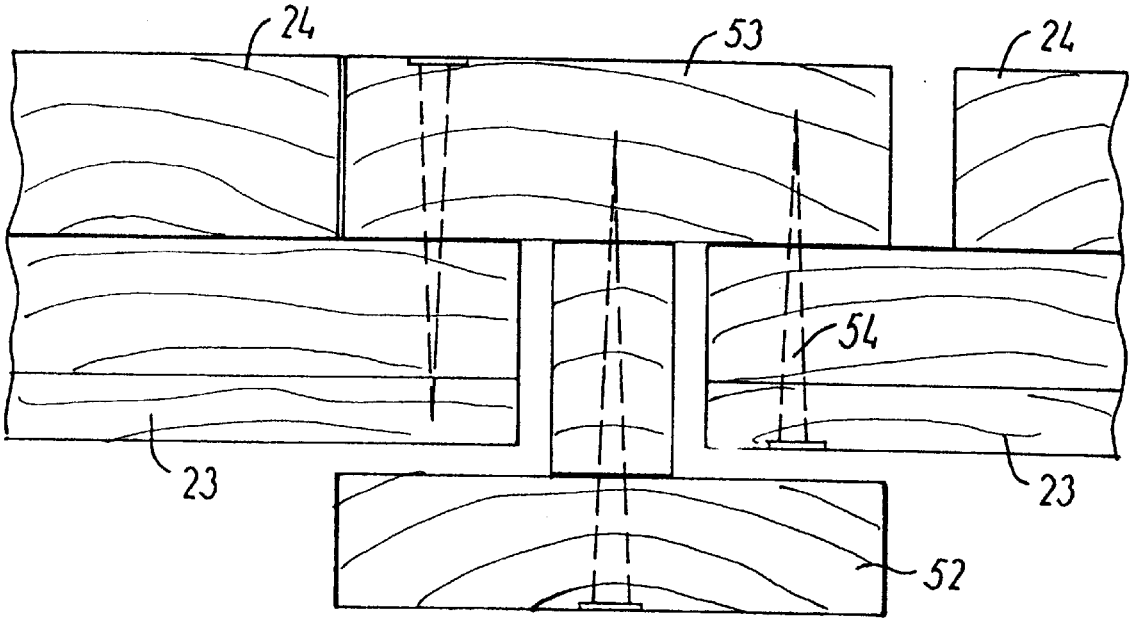
Figure 14:
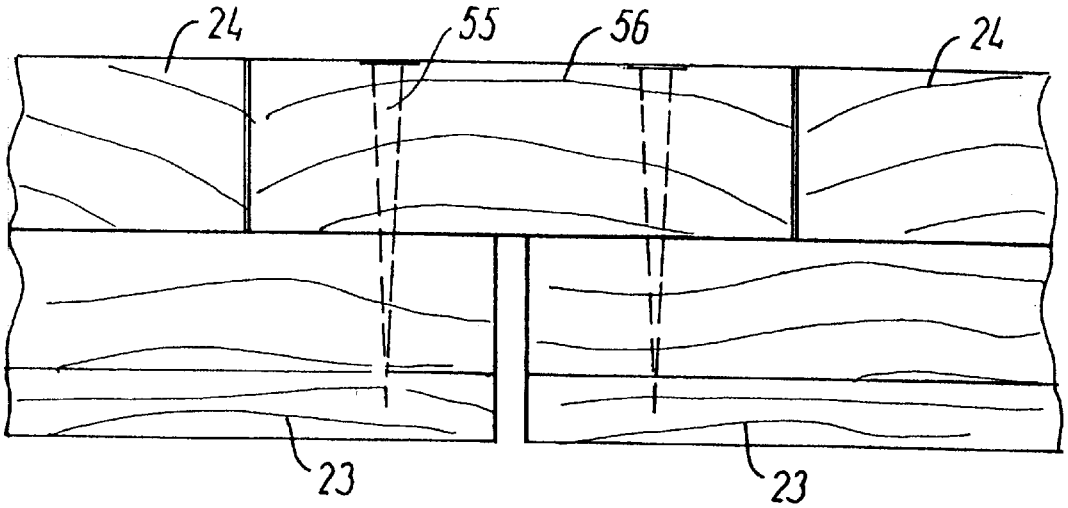
Figure 15A:
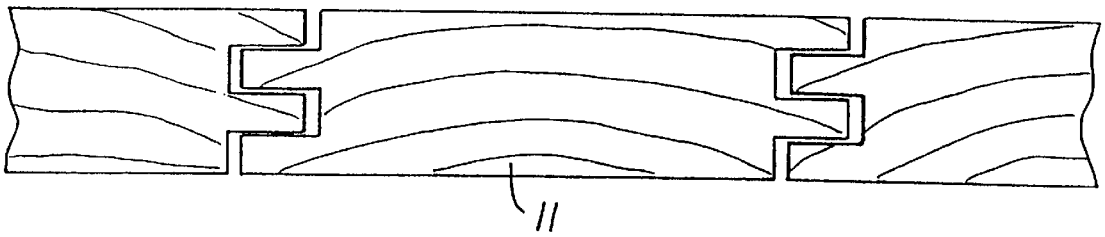
Figure 15B:
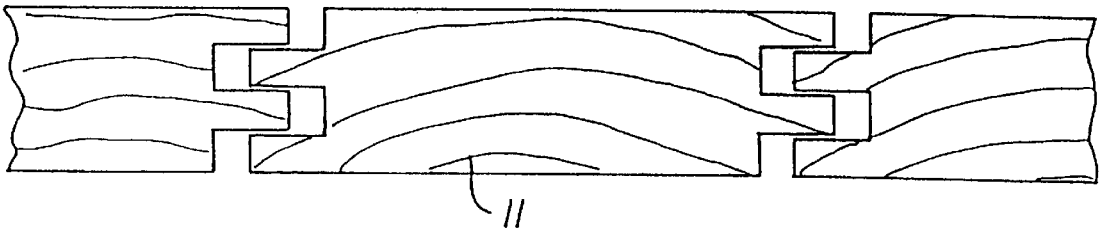
Figure 15C:
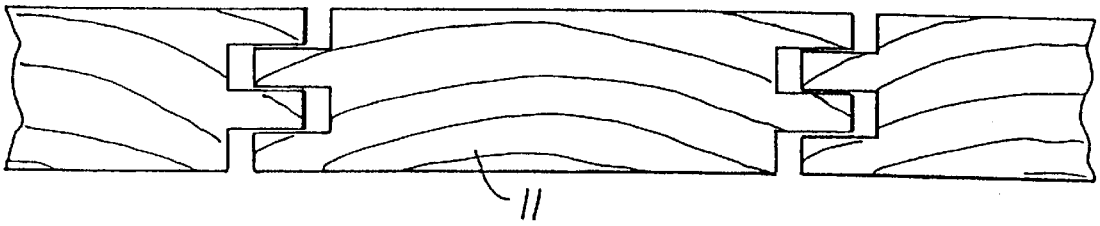

FIGS. 13 and 14 corresponding examples of interconnection of the embodiment shown in FIG. 3, and FIG. 15 illustrates the junction of board members to a wall element with varying moisture content in wood.

FIG. 1 shows an example of a major wooden building, eg. a barn, where the facade situated under the roof 1 is constructed by wall elements according to the invention, said elements comprising from the base 2 three overlying bays 3, 4 and 5 consisting of wall elements with a boarding of vertically disposed bars surmounted by two overlying bays 6 and 7 constituted by wall elements with boarding of horizontally disposed elements.

All wall elements are preferably manufactured in dimensions permitting that both under transport and on the building site, they may be handled by two men. A modular dimension suitable hereto for the wall element is eg. 120 cm in the height and 240 cm in the length.

In order to obtain an appropriate balancing of manufacturing tolerances, there should in the individual bays at suitable distances be provided flexible transitions 8 between wall elements arranged side by side. In the three bays 3, 4 and 5 with vertically disposed bars, it will in general be sufficient to have such flexible transitions with a division of eg. 480 cm whereas in the bays 6 and 7 with horizontally positioned board members, it may be necessary to have a flexible transition between each pair of juxtaposed wall elements, ie. with a division of 240 cm.

In a wall section as shown in FIG. 1 there may, perhaps by using special bracing elements 9, in a usual way be provided apertures as eg. a gate aperture 10. In a corresponding way doors and windows may be provided through application of special elements in dimensions differing from above-mentioned modular dimension.

FIGS. 2 and 4 show in vertical and horizontal sections an embodiment of a wall element where the boarding is formed by vertically disposed bars 11 which on the inside is fastened by an upper lath element 12 and a lower lath element 13.

The board members 11, which all have the same length, are joined side by side by designing their opposite side edges with cooperating engagement members which form a labyrinth seal with at least two series connected pressure-reducing chambers for wind loads on the exterior of the member. In the shown embodiment the labyrinth seal is formed by double tongue-and-groove joints, two parallel tongues 14 being designed at one side edge of each element and at the opposite side edge, two matching parallel grooves 15.

The board members 11 are fastened to the lath elements 12 and 13 by means of screw connections 16 which through the lath elements 12 and 13 are inserted in the backside of the board members 11.

Through this design of the joint between neighboring board members, a labyrinth seal 17 is formed which between the exterior 18 and the interior 19 of the boarding provides a pressure-reducing canal with three series connected pressure-reducing chambers 20–22 for accommodating wind loads on the exterior of the wall element.

The labyrinth seal 17 is further designed in such a way that against the exterior 18 of the element 11, it forms a drainage slit 17*a* for removal of water collected in the pressure-reducing chamber 20 situated nearest the exterior.

With a view thereto, the opposite side edges of the bars 11 are preferably designed as shown in FIGS. 6 such that the part of the side edge situated between the external side 18 and the said pressure-reducing chamber 20 is bevelled so as to form a wedge-shaped slit 17*a* together with the corresponding part of the neighboring element to which it is connected.

Figure 5:
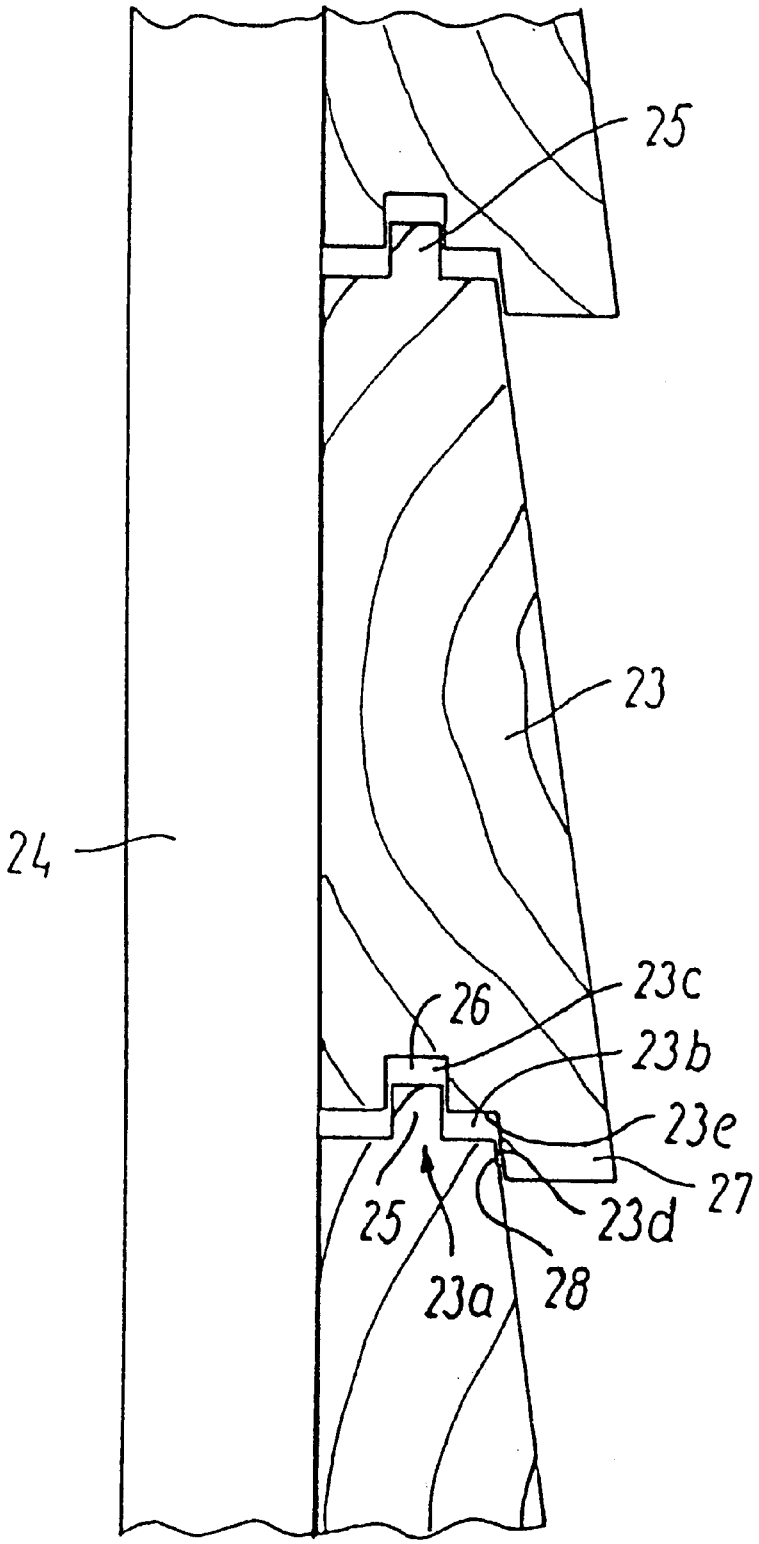

The embodiment shown in FIGS. 3 and 5 of a wall element with horizontally disposed boarding is constructed according to the same fundamental principle and it comprises a number of overlying board members 23 with equal length and fastened on the backside to vertically disposed lath elements 24 by means of screw connections, not shown, designed in the same way as explained above for the embodiment in FIGS. 2 and 4.

In the embodiment in FIGS. 3 and 5, the individual board members have, in order to produce a clinker-built appearance of the assembled wall element, an essentially wedge-shaped cross section with largest width at the bottom side edge. The joint between neighboring elements is also here designed as a tongue-and-groove joint, each element at the top edge having a tongue 25 and in the bottom edge a matching groove 26. For obtaining the labyrinth seal 23*a* essential to the invention at the joints, each board member 23 is at its lower side further designed with an external nose portion 27 which at the joint with an underlying element as shown in FIG. 5 covers a top edge zone 28 of the exterior of the underlying element.

The two pressure-reducing chambers 23*b* and 23*c* in the labyrinth joint 23*a* is thus formed partially between the external nose portion 27 and the tongue 25, partially at the bottom of the groove 26, whereas a drainage slit 23*d* is formed between the nose 27 and the edge zone 28 covered thereby.

As shown in FIG. 7, the horizontal board members 23 are preferably designed such that the part 23*e* of the underside of the element situated between the groove 26 and the nose portion 27 for forming the pressure-reducing chamber 23*b* is staggered in relation to the part 23*f* situated against the inside of the member. Furthermore, the top edge zone 28 is designed as a depression with a bevelled underside 28*a*.

In order to permit interconnection of the wall elements above each other in an essentially stressfree structure, the wall elements are at their top edge and bottom edge according to the invention designed with cooperating bevel faces such that an actual fastening with screw or bolt connections to the supporting building structure only need to be effected at the top edge. In the embodiment in FIGS. 2 and 4, such bevelled faces 29 and 30 are thus procured at the underside of the lower lath element 13 and at the top edges of the bars 11. Furthermore, there may be designed a bevel face 30*a* at the lower edges of the bars 11. By all these bevel faces, the bevel at horizontal may typically be 30°.

Correspondingly in the embodiment in FIGS. 3 and 5, the top and bottom end edges of the lath elements 24 are designed with parallel bevel faces 31 and 32 which in order to permit the interconnection with a underlying wall element of the embodiment shown in FIGS. 2 and 4 must have a bevel adapted to the bevel face 30 in this embodiment.

Figure 8:
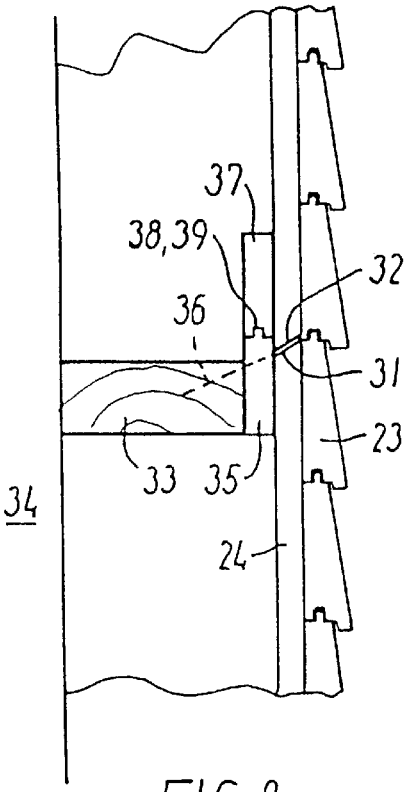
Figure 9:
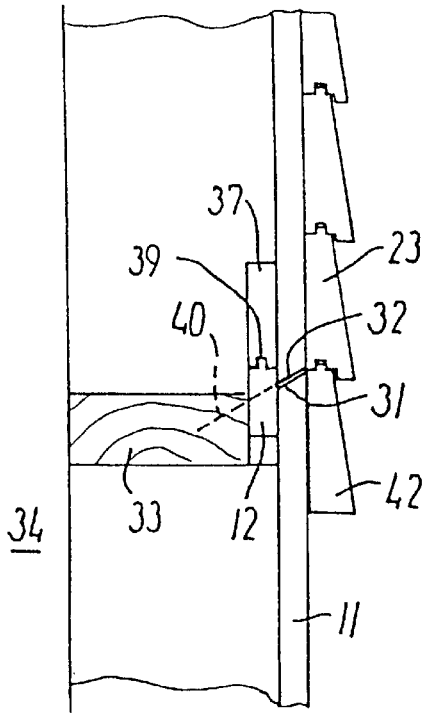
Figure 10:
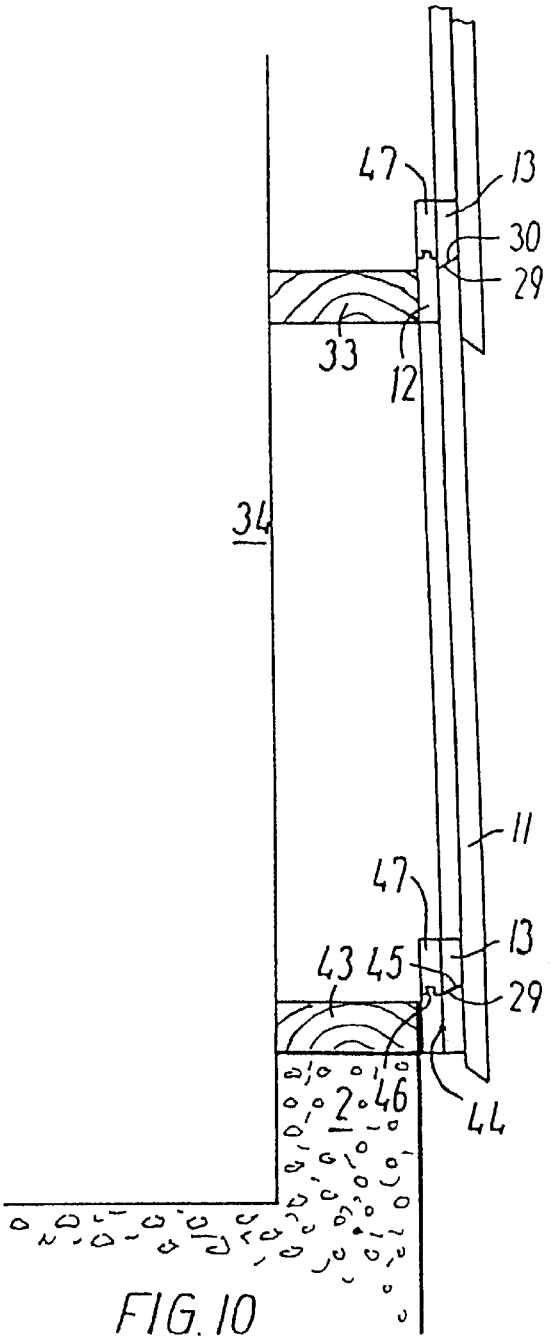

The interconnection of overlying wall elements may be performed as illustrated in FIGS. 8–10.

FIG. 8 thus shows the interconnection of two overlying wall elements of the embodiment shown in FIGS. 3 and 5. The interconnection is performed opposite a horizontal board member 33 which is fastened to posts 34 in the supporting building structure. To the backside of the lath elements 24 at the top edge thereof is fastened a horizontal lath element 35 which by a screw or bolt connection 36 is fastened to the beam element 33. The bevel faces 31 and 32 entail per se a locked engagement between the bottom edge of the upper wall element and the top edge of the lower wall element.

For a further improvement of the fastening and at the same time a retention of an essential stressfree structure, there may on the backside of the lath elements 24 upon mounting of the overlying wall element be fastened a mounting and covering lath element 37 whose underside is designed with an engagement member, eg. a groove 38 for interconnection with a corresponding engagement member eg. a tongue 39 in the upper side of the lath element 35.

In FIG. 9 is in a corresponding way illustrated an interconnection of an overlying wall element of the embodiment shown in FIGS. 3 and 5 with an underlying wall element of the embodiment shown in FIGS. 2 and 4. Also in this case, the interconnection is made opposite a horizontal beam element 33 which is fastened to the post 34 in the supporting building structure. The underlying wall element is fastened to the beam 33 by a screw connection 40 through the top lath element 12.

The locking engagement procured by the bevel faces 31 and 32, per se, may in the same way as in FIG. 6 be improved by the engagement of the mounting and covering lath element 37 with a tongue 39 designed in the upper side of the upper lath element 12.

After the interconnection the top part of the underlying wall element may as shown be covered by inserting an additional horizontal clinker element 42 in the lower board member 23 in the overlying wall element. This additional element 42 may be fastened to the bars 11 in the underlying wall element.

Finally, in FIG. 10 is illustrated the interconnection af two overlying wall elements of the embodiment shown in FIGS. 2 and 4, ie. with vertically disposed bars and the interconnection between the underlying wall element and a wall plate 43 which is fastened to the base 2 in the building structure. To the wall plate 43 is fastened a special lath element 44 which, on one hand, has at its top side an external bevel face 45 for abutment against the bevel face 29 at the underside of the lower lath element 13 of the wall element and, on the other hand, at the inside a tongue 46 for procurement of a tongue-and-groove joint with the mounting and covering lath element 47 which is fastened to the lower lath element 13 after the wall element is positioned with the bevel faces 29 and 45 in mutual engagement.

The underlying wall element ist then fastened to the beam 33 by a screw connection, not shown, through the upper lath element 12.

The overlying wall element may then be mounted by engagement between the bevel face 29 at the underside of the lower lath element 13 of this wall element and the bevel face 30 at the top edges of the bars 11 in the underlying wall element whereupon the interconnection may be ensured, in the same way as described in the foregoing, by means of a mounting and covering lath element 47.

Figure 11:
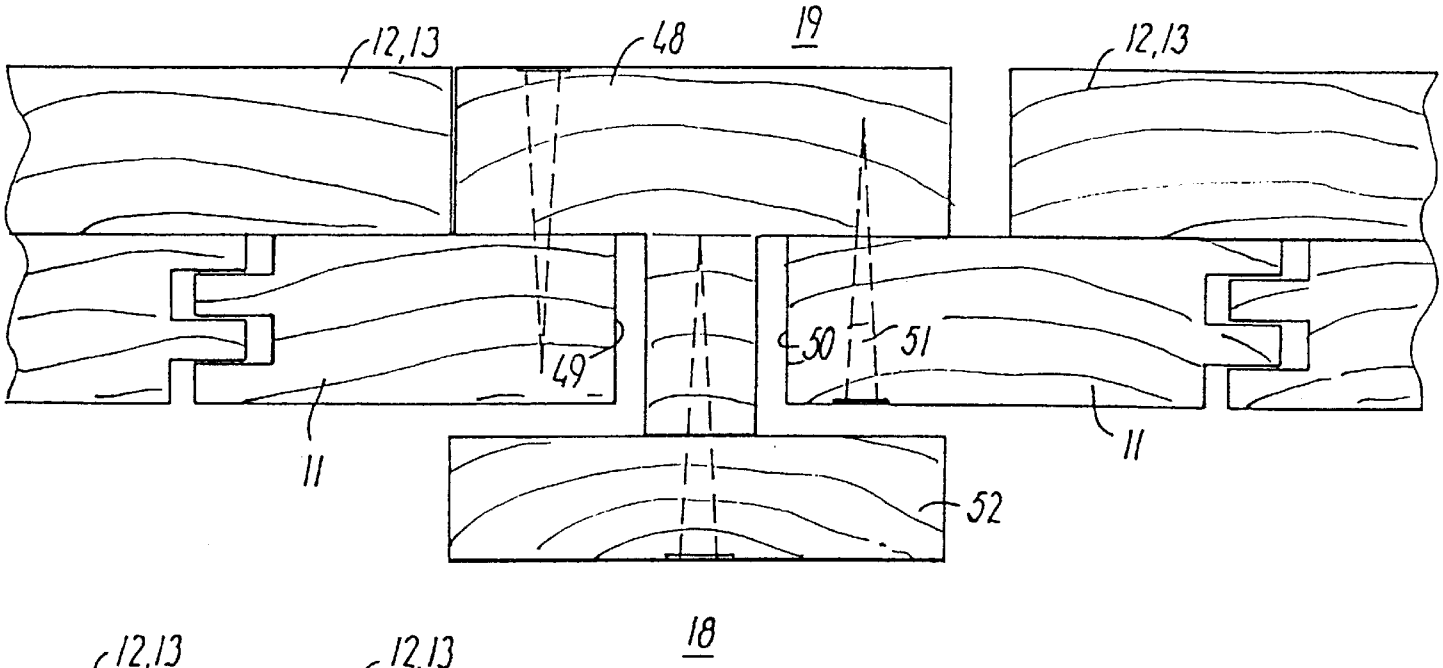
Figure 12:
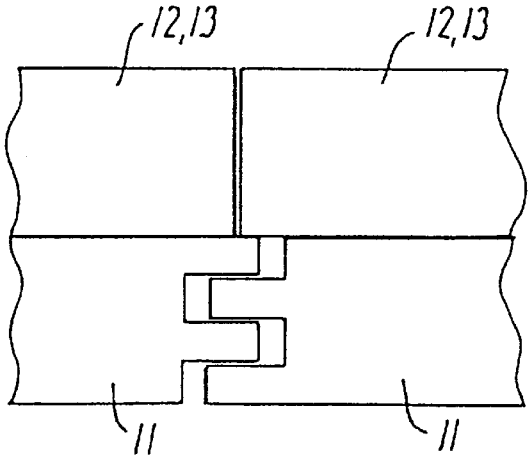

FIGS. 11 and 12 show examples of the interconnection of wall elements of the embodiment shown in FIGS. 2 and 4 in the horizontal direction. On the places where a flexible interconnection as shown in FIG. 1 is desired, the two outer bars 11 in the two wall elements are fastened to a post element 48 which is fastened to the supporting building structure, eg. on the outside of the beams 33 shown in FIGS. 8–10 such that the post element 48 will flush with the lath elements 12, 13 of the wall element. In order to permit this fastening, the upper and lower lath element 12, 13 have their end edges spaced from the opposite vertical side edges 49 and 50 of the outer bars 11.

If the fastening of an outer bar 11 to the post element 48 as shown in FIG. 11 is made by means of a screw connection 51 which is inserted from the outside, such screw connections may be covered by mounting an exterior covering board 52.

On places where there is no need for any flexible interconnection the wall elements arranged side by side may be joined directly by a tongue-and-groove joint of the outer mutually facing bars 11, as shown in FIG. 12.

According to same principles, a flexible and non-flexible, respectively, interconnection of wall elements of the embodiment in FIGS. 3 and 5 may be designed as shown in FIGS. 13 and 14.

As shown in FIG. 13, the vertically disposed lath elements 24 may at the opposite vertical side edges of the wall elements be spaced from the mutually flushing end edges of the board members 23 in order to permit the fastening thereof to a post element 53 which may be fastened to the supporting building structure in the same way as the post element 48 in FIG. 11. The fastening may thus be made by screw connections 54 with the board members 23 in direct engagement against the post element 53.

Just as in FIG. 11 there may for covering of externally accessible screw connections be mounted external covering boards.

In the non-flexible interconnection which is shown in FIG. 14, the wall elements arranged side by side may be means of screw connections 55 be screwed directly to a separate lath element 56 which is positioned between the lath elements 24 in the wall elements arranged side by side.

In order to enable a retention of an essentially stressfree structure under varying moisture conditions, it is according to the invention substantial that the junction of the board members arranged side by side in the individual wall elements is made under controlled moisture conditions so that there is made room for the tongue-and-groove joints between the individual board members to work, ie. to expand or to contract dependent on the moisture content of the wood without this resulting in deformations in the wall element as a whole.

An essential part of the production of wall elements is therefore that the board members as illustrated in FIG. 15 for the elements 11 in the embodiment shown in FIGS. 2 and 4 are cut uniformly with the grains running essentially parallel to the external and internal sides and that at the joint of the elements 11, an adaptation is made of the engagement in the tongue-and-groove joints in correspondence with the moisture content determined at the time of junction.

By a, b and c in FIG. 15 is illustrated how the junction may typically be made with a moisture content in the wood of 23%, 9% and 16% respectively.

I claim:

1. A wall element for wooden buildings, the wall element comprising a transportable assembly of a number of board members (11, 23) of uniform length fastened side by side to transverse lath elements (12, 13; 24) on the inside of the board members in the proximity of mutually flush end edges of the board members, the opposite side edges of the board members being designed with cooperating engagement members, characterized in that the engagement members between two neighboring board members form a labyrinth seal (17, 23*a*) with a continuous pressure-reducing channel from an exterior to an interior of the board member, said pressure-reducing channel having at least two series continuously connected pressure-reducing chambers (20–22; 23*b*–23*c*) for wind load on the exterior of the board member, which labyrinth seal forms against the external side of the board member a drainage slit (17*a*, 23*d*) for removal of water collected from the pressure-reducing chamber (20, 23*b*) situated nearest said external side.

2. A wall element according to claim 1, characterized in that at top and bottom edges of the wall element, the wall element is designed with cooperating bevel faces (29–32) for joining overlying wall elements in a locked engagement.

3. A wall element according to claim 2, characterized in that the board members form vertically disposed bars (11) and that the lath elements (12) comprise an upper lath element (12) flush with the top end edges of the bars (11) and a lower element (13) situated at a distance above the bottom edges of the bars (11), said bevel faces (29–30) being provided at the underside of the lower lath element (13) and at the top edges of the bars (11).

4. A wall element according to claim 3, characterized in that the upper lath element (12) is at its top side designed with an engagement member (41) for joining an engagement member in the lower side of a mounting and covering lath element (37) which after the mounting of an overlying wall element is fastened along the lower lath element thereof for fastening the overlying element by means of said engagement.

5. A wall element according to claim 3, characterized in that the upper and lower lath elements (12, 13) have their end edges positioned at such a distance from the opposite vertical side edges of the wall element as to allow fastening of the wall element to posts (48) in a supporting building structure with the parts of the outer bars (11) positioned outside the lath elements (12–13) engaged directly with such posts.

6. A wall element according to claim 3, 4 characterized in that the labyrinth seal (17) between the mutually butting side edges of neighboring bars (11) is formed by a double groove-and-tongue joint with said pressure-reducing chambers (20–22) provided at the bottom of the grooves.

7. A wall element according to claim 6, characterized in that said tongue-and-groove joint is designed with such tongue-and-groove dimensions that a stressfree joint is obtained at a predetermined maximum moisture content.

8. A wall element according to claim 1, characterized in that the board members form horizontally disposed elements (23) with an essentially wedge-shaped cross section with largest width at the bottom side edge for creation of a clinker-built appearance of the assembled wall element, and are connected by means of said transverse lath elements (24) being disposed vertically.

9. A wall element according to claim 8, characterized in that the labyrinth seal (23*a*) between two mutually butting side edges of neighbouring board members (23) comprises a groove-and-tongue joint with an upward projecting tongue (25) from the top side of the board member and a groove (26) in the underside and an external downward projecting nose portion (27) outside said groove (26), said drainage slit (23*d*) being provided between said nose portion (27) and a top edge zone of the exterior of the underlying board member covered thereby.

10. A wall element according to claim 9, characterized in that the pressure-reducing chamber (23*b*) situated nearest the exterior of the wall element is limited by staggering the part (23*e*) of the lower side of the board member (23) situated between the groove and the nose portion.

11. A wall element according to claim 9, characterized in that the vertically disposed lath elements (24) are positioned at a distance from the mutually flush end edges of the board members which allow fastening of the wall element to posts (53) in a supporting building structure with end zones of the board members (23) engaged directly with such posts.

12. A wall element according to claim 9, characterized in that, at the exterior of the wall element, said drainage slit has a wedge-shaped mouth (23*d*) shaped by designing said top edge zone (28) as a depression with a bevelled lower face (28*a*).

13. A wall element according to claim 8, characterized in that the wall element has top and bottom edges and, at the top and bottom edges, has cooperating bevel faces for joining overlying wall elements in a locked engagement, the vertically disposed lath elements have top and bottom end edges, and the top and bottom end edges of the vertically disposed lath elements (24) are designed with parallel bevel faces (31, 32).

14. A wall element according to claim 8, characterized in that to the top ends of the vertically disposed lath elements (24), on the inside of the lath elements is fastened a horizontal lath element (35) for fastening of a beam element (33) in the supporting building structure, which horizontal lath element at its upper side is designed with an engagement member for assembling with an engagement member in the lower side of a mounting and cover lath element (37) which upon mounting of an overlying wall element is fastened along the lower board member (23) thereof.

15. A wall element according to claim 1, characterized in that said drainage slit **(17, 23*d*) has a wedge-shaped mouth at the exterior of the wall element (11, 23)**.

16. A wall element according to claim 1, characterized in that the drainage slit comprises a space between neighboring board members.

17. A method for manufacture of a wall element according to claim 1, characterized in that the board members (11) are cut up with the grains running essentially parallel to the external and the internal sides, that the moisture content of the wood is determined, and that at the junction of the board members with the lath elements there is performed an adaptation of the engagement between said engagement members in accordance with the thus controlled moisture conditions.

18. A method for erection of a wood building with with a facade consisting of wall elements according to claim 4, characterized in that at its vertical side edges and at its top edge, each wall element is fastened by screw connections to vertical posts and a horizontal beam element, respectively, in a supporting structure of the building, whereas at its lower edge, it is only retained to an underlying element or to a wall plate in the building structure by means of said bevel faces (29–30) and mounting element (37).

19. A method according to claim 18, characterized in that said screw connection (51, 54) at the vertical side edges is covered by mounting of external covering boards (52).

* * * * *